US012590402B2

(12) United States Patent
Kim

(10) Patent No.: US 12,590,402 B2
(45) Date of Patent: Mar. 31, 2026

(54) DRYER

(71) Applicant: LG ELECTRONICS INC., Seoul (KR)

(72) Inventor: Yang Gyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 896 days.

(21) Appl. No.: 17/789,630

(22) PCT Filed: Dec. 17, 2020

(86) PCT No.: PCT/KR2020/018604

§ 371 (c)(1),
(2) Date: Jun. 28, 2022

(87) PCT Pub. No.: WO2021/157853

PCT Pub. Date: Aug. 12, 2021

(65) Prior Publication Data

US 2023/0035979 A1 Feb. 2, 2023

(30) Foreign Application Priority Data

Feb. 6, 2020 (KR) ..... 10-2020-0014322

(51) Int. Cl.
*D06F 58/20* (2006.01)
*D06F 58/10* (2006.01)
(Continued)

(52) U.S. Cl.
CPC ..... *D06F 58/206* (2013.01); *D06F 58/10* (2013.01); *D06F 58/22* (2013.01); *D06F 58/24* (2013.01); *D06F 58/26* (2013.01)

(58) Field of Classification Search
CPC ..... D06F 58/206; D06F 58/10; D06F 58/22; D06F 58/26
See application file for complete search history.

(56) References Cited

U.S. PATENT DOCUMENTS

2010/0101606 A1 4/2010 Grunert
2013/0255095 A1* 10/2013 Bommels ..... D06F 58/22 34/85

(Continued)

FOREIGN PATENT DOCUMENTS

CN 1585880 A 2/2005
CN 101652514 A 2/2010

(Continued)

OTHER PUBLICATIONS

Extended European Search Report in European Appln. No. 20917341.8, mailed on Jan. 2, 2024, 7 pages.

(Continued)

*Primary Examiner* — Connor J Tremarche
(74) *Attorney, Agent, or Firm* — Fish & Richardson P.C.

(57) ABSTRACT

A dryer and an operation method thereof are useful in a 5G environment provided for the Internet of Things. The dryer includes a heating device, a tumbler having an entrance connected to the heating device, a fan provided connected to the exit of the tumbler, a heat exchanger disposed in a flow line of a working fluid connected to the exit of the fan, a compressor having an entrance connected to a circulation line of the working fluid connected to the exit of the fan and an exit connected to the entrance of the heat exchanger, and a first cleaning unit connected to the entrance of the heat exchanger and to the exit of the heat exchanger.

20 Claims, 4 Drawing Sheets

(51) Int. Cl.

| | |
|---|---|
| ***D06F 58/22*** | (2006.01) |
| ***D06F 58/24*** | (2006.01) |
| ***D06F 58/26*** | (2006.01) |

(56) References Cited

U.S. PATENT DOCUMENTS

| | | | | |
|---|---|---|---|---|
| 2014/0144035 | A1* | 5/2014 | Vian | D06F 58/24 34/73 |
| 2016/0115643 | A1* | 4/2016 | Bison | D06F 58/24 34/75 |
| 2017/0145624 | A1 | 5/2017 | Dulberg et al. | |
| 2019/0024299 | A1* | 1/2019 | Ryu | D06F 58/22 |

FOREIGN PATENT DOCUMENTS

| | | | | |
|---|---|---|---|---|
| CN | 202390689 | U | 8/2012 | |
| CN | 107109768 | A | 8/2017 | |
| CN | 108603328 | A | 9/2018 | |
| EP | 2719819 | A1 * | 4/2014 | D06F 58/24 |
| EP | 3405610 | B | 11/2018 | |
| EP | 3505040 | A1 | 7/2019 | |
| JP | H11-164979 | A | 6/1999 | |
| JP | 2014023574 | | 2/2014 | |
| KR | 20110123341 | | 11/2011 | |
| KR | 20120005266 | | 1/2012 | |
| KR | 20120110495 | | 10/2012 | |
| KR | 10-1639798 | B1 | 7/2016 | |
| KR | 20190127037 | | 11/2019 | |
| WO | 2014/038112 | A1 | 3/2014 | |

OTHER PUBLICATIONS

Office Action in Chinese Appln. No. 202080093979.5, mailed on Mar. 12, 2025, 18 pages (with English translation).

* cited by examiner

DRYER

CROSS-REFERENCE TO RELATED APPLICATIONS

This application is a National Stage application under 35 U.S.C. § 371 of International Application No. PCT/KR2020/018604 filed on Dec. 17, 2020, which claims benefit of priority to Korean Application No. 10-2020-0014322, filed Feb. 6, 2020. The disclosures of the prior applications are incorporated by reference in their entirety.

TECHNICAL FIELD

The present disclosure relates to a dryer and an operation method thereof, and more particularly to a dryer for drying laundry.

BACKGROUND ART

The content described in this section simply provides background information related to embodiments, and does not constitute the related art.

A dryer is used to dry an object to be dried, such as laundry. A dryer may be categorized into a gas type, an electric-heating type, and a heat-pump type depending on the method of obtaining heat for heating an object to be dried.

The gas type is a type that heats an object to be dried using heat generated by burning combustible gas. The gas-type dryer has disadvantages in that the overall size thereof is large and the structure thereof is complicated in order to receive gas supplied from outside.

The electric-heating type is a type that heats an object to be dried using heat obtained from an electric heater. The electric-heating-type dryer has advantages in that the size thereof is small and the structure thereof is simple.

However, because the electric-heating-type dryer uses electricity, which is an expensive energy source, the same is disadvantageous from the aspect of costs and energy efficiency.

The heat-pump type is a type that heats an object to be dried using heat obtained by transferring heat from a low-temperature thermal reservoir to a high-temperature thermal reservoir using a compressor.

The heat-pump-type dryer may obtain heat using a compressor, and may use electricity to operate the compressor.

However, unlike the electric-heating type, which generates heat by converting electricity into heat, the heat-pump type obtains heat by collecting heat from a low-temperature thermal reservoir and transferring the same to a high-temperature thermal reservoir, and is thus advantageous in that less power is consumed than in the case of the electric-heating type.

The demand for a heat-pump-type dryer, which has the advantage of low power consumption, is continually increasing, and accordingly, research and development related thereto is being actively carried out.

DISCLOSURE OF INVENTION

Technical Problem

An object of the present disclosure is to provide a dryer having a structure capable of effectively cleaning components thereof, thereby exhibiting improved performance and a longer lifespan.

An object of the present disclosure is to provide a dryer having a structure capable of preventing foreign substances from accumulating in a circulation line of a heat exchanger and components disposed in the circulation line.

An object of the present disclosure is to provide a dryer having a structure capable of effectively cleaning a heat exchanger.

An object of the present disclosure is to provide a dryer having a structure capable of effectively cleaning a compressor.

Solution to Problem

In order to accomplish the above objects, a dryer according to an embodiment of the present disclosure may include a heating device, a tumbler having an entrance connected to the heating device, a fan provided so as to be connected to the exit of the tumbler, a heat exchanger disposed in a flow line of a working fluid connected to the exit of the fan, a compressor having an entrance connected to a circulation line of the working fluid connected to the exit of the fan and an exit connected to the entrance of the heat exchanger, and a first cleaning unit connected to the entrance of the heat exchanger and to the exit of the heat exchanger.

The first cleaning unit may include a first reservoir having an entrance connected to the exit of the heat exchanger, and a first pump having an exit connected to the entrance of the heat exchanger.

The first cleaning unit may further include a first cleaning line interconnecting the first reservoir and the first pump. The first cleaning line may have an end connected to the first reservoir and an opposite end connected to a non-circulation line interconnecting the compressor and the heat exchanger.

A first valve, which is configured as a three-way valve, may be disposed at a connecting point between the first cleaning line and the non-circulation line.

The first reservoir may have an exit connected to the first cleaning line, and may be provided at the exit thereof with a first filter.

The non-circulation line may interconnect the heat exchanger and the first reservoir.

The dryer according to the embodiment of the present disclosure may further include a discharge line branching from the non-circulation line interconnecting the heat exchanger and the first reservoir, and a second reservoir connected to the exit of the discharge line.

A second valve, which is configured as a three-way valve, may be disposed at a connecting point between the non-circulation line and the discharge line.

In a heat exchanger cleaning mode, the working fluid stored in a liquid state in the first reservoir may sequentially flow through the first filter, the first pump, the first valve, the heat exchanger, and the second valve to clean the heat exchanger.

The dryer according to the embodiment of the present disclosure may further include a second reservoir disposed at the end of the non-circulation line and connected to the heat exchanger.

In the heat exchanger cleaning mode, the working fluid stored in a liquid state in the first reservoir may be discharged from the first reservoir, and may sequentially flow through the first pump, the first valve, the heat exchanger, and the second reservoir to clean the heat exchanger.

The first reservoir may be provided at the exit thereof with a first filter.

The dryer according to the embodiment of the present disclosure may further include a second cleaning unit connected to the entrance of the compressor and to the exit of the compressor.

The second cleaning unit may include a second cleaning line having an entrance connected to the first reservoir and an exit connected to the compressor.

The non-circulation line may interconnect the circulation line and the compressor.

The second cleaning line may be connected to the first cleaning line at a point downstream of the exit of the first reservoir, and may be connected to the non-circulation line at a point between the circulation line and the compressor.

The dryer according to the embodiment of the present disclosure may further include a third valve disposed at a connecting point between the non-circulation line and the second cleaning line, and a fourth valve disposed at a connecting point between the first cleaning line and the second cleaning line.

Each of the third valve and the fourth valve may be configured as a three-way valve.

The dryer according to the embodiment of the present disclosure may further include a second pump disposed in the second cleaning line.

In a compressor cleaning mode, the working fluid stored in a liquid state in the first reservoir may be discharged from the first reservoir, may sequentially flow through the fourth valve, the second pump, and the third valve, and may be introduced into the compressor.

The tumbler may be provided at the exit thereof connected to the fan with a second filter.

Advantageous Effects of Invention

According to embodiments of the present disclosure, foreign substances contained in the working fluid in the tumbler may be filtered out by the second filter when the working fluid is discharged from the tumbler. Accordingly, it is possible to effectively prevent foreign substances, such as lint, from moving through the circulation line and the non-circulation line and collecting in the respective components of the dryer.

According to embodiments of the present disclosure, the dryer may clean the heat exchanger using the first cleaning unit, thereby effectively preventing foreign substances, such as lint, from collecting in the heat exchanger, and consequently effectively preventing performance deterioration, malfunction, and lifespan reduction of the heat exchanger due to the foreign substances.

According to embodiments of the present disclosure, the dryer may clean the compressor using the second cleaning unit, thereby effectively preventing foreign substances, such as lint, from collecting in the compressor, and consequently effectively preventing performance deterioration, malfunction, and lifespan reduction of the compressor due to the foreign substances.

BRIEF DESCRIPTION OF DRAWINGS

The foregoing and other objects, features, and advantages of the invention, as well as the following detailed description of the embodiments, will be better understood when read in conjunction with the accompanying drawings. For the purpose of illustrating the invention, there is shown in the drawings an exemplary embodiment that is presently preferred, it being understood, however, that the invention is not intended to be limited to the details shown because various modifications and structural changes may be made therein without departing from the spirit of the invention and within the scope and range of equivalents of the claims. The use of the same reference numerals or symbols in different drawings indicates similar or identical items.

DESCRIPTION OF REFERENCE NUMERALS OF MAIN PARTS OF THE DRAWINGS

Figure 1:
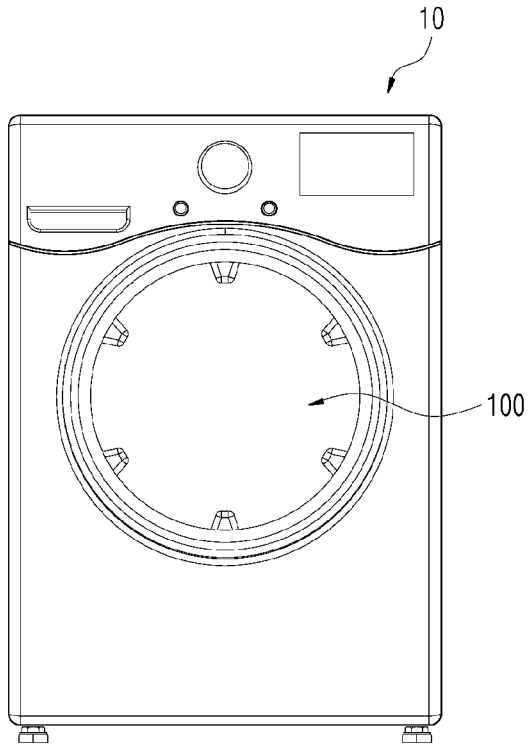
FIG. 1 is a view showing the external appearance of a dryer according to an embodiment of the present disclosure.

10: user interface
21: circulation line
22: first cleaning line
23: non-circulation line
24: discharge line
25: second cleaning line
100: tumbler
110: second filter
200: fan
300: heat exchanger
400: compressor
500: heating device
600: accommodation part
710: first reservoir
711: first filter
720: first pump
730: second reservoir
740: second pump
810: first valve
820: second valve
830: third valve
840: fourth valve

BEST MODE FOR CARRY OUT THE INVENTION

Hereinafter, exemplary embodiments of the present disclosure will be described in detail with reference to the accompanying drawings. In the following description of the present disclosure, a detailed description of known functions and configurations incorporated herein will be omitted to make the gist of the present disclosure clear.

FIG. 1 is a view showing the external appearance of a dryer according to an embodiment. The dryer according to the embodiment may be used, for example, to dry laundry that has not been dried after completion of washing. Of course, the dryer may also be used to dry wet clothes, regardless of whether washing is performed.

An object to be dried may be received in a tumbler 100 provided in the dryer. Referring to FIG. 1, the tumbler 100 may be formed, for example, in a cylindrical shape, and may be provided so as to be rotatable. When a heated working fluid flows into the entrance of the tumbler 100, the object to be dried received in the tumbler 100 may be dried by the heated working fluid.

The dryer may be provided with a user interface 10. The user interface 10 may be electrically connected to a controller to be described later, and a user may control the operation of the dryer using the user interface 10.

For example, the user interface 10 may be provided with a display, a capacitive touch button, a physical button, a dial, a speaker through which the dryer utters a voice, a microphone through which the user inputs a voice command, and the like.

Therefore, the user may obtain information necessary for operation from the dryer in the form of text, a voice, or the like. In addition, the user may input a voice command, or may manually manipulate the button, the dial, or the like in order to operate the dryer.

The dryer may further include a transceiver, which is connected to the controller, and the controller may communicate with a server, a terminal of the user, and other external devices through the transceiver.

The transceiver may include at least one of a mobile communication module or a wireless Internet module. In addition, the transceiver may further include a short-range communication module.

The mobile communication module transmits and receives wireless signals to and from at least one of a base station, an external terminal, or a server via a mobile communication network established according to technical standards or communication schemes for mobile communication (for example, global system for mobile communication (GSM), code division multi access (CDMA), code division multi access 2000 (CDMA2000), enhanced voice-data optimized or enhanced voice-data only (EV-DO), wideband CDMA (WCDMA), high speed downlink packet access (HSDPA), high speed uplink packet access (HSUPA), long term evolution (LTE), long term evolution-advanced (LTE-A), $5^{th}$ generation (5G) mobile communication, and the like).

The wireless Internet module refers to a module for wireless Internet access. The wireless Internet module may be provided in the dryer. The wireless internet module is configured to transmit and receive wireless signals via a communication network using wireless Internet technology.

The dryer may transmit and receive data to and from a server and various terminals capable of performing communication via a 5G network. In particular, the dryer may perform data communication with the server and the terminals using at least one service among enhanced mobile broadband (eMBB), ultra-reliable and low latency communications (URLLC), and massive machine-type communications (mMTC) via a 5G network.

Enhanced mobile broadband (eMBB) is a mobile broadband service, and multimedia content, wireless data access, etc. are provided over eMBB. Further, improved mobile services, such as hotspots and broadband coverage for receiving mobile traffic, the amount of which is tremendously increasing, may be provided over eMBB. Through hotspots, high-volume traffic may be received in an area in which user mobility is low and user density is high. Through broadband coverage, a wide-range and stable wireless environment and user mobility may be ensured.

An ultra-reliable and low latency communications (URLLC) service defines much more stringent requirements than existing LTE in terms of reliability in data transmission/reception and transmission delay, and 5G services for automation of production processes at industrial sites, telemedicine, telesurgery, transportation, safety, etc. are representative examples thereof.

A massive machine-type communications (mMTC) service is a service that is not sensitive to transmission delay and is required for transmission of a relatively small amount of data. Terminals present in a much larger number than general mobile phones, such as sensors, may be connected to a wireless access network by mMTC at the same time. In this case, the communication module of the terminal needs to be inexpensive, and there is a need for improved power efficiency and power-saving technology enabling operation for years without replacement or recharging of a battery.

The dryer of the embodiment may employ a thermodynamic cycle in order to apply heat to the object to be dried received in the tumbler 100.

A working fluid used to implement the thermodynamic cycle of the dryer may be a mixture of air and gaseous water, i.e. steam. In this case, the ratio of air to steam in the working fluid may change while the working fluid circulates through the respective components of the dryer. Further, liquid water may temporarily account for part of the working fluid.

Figure 2:
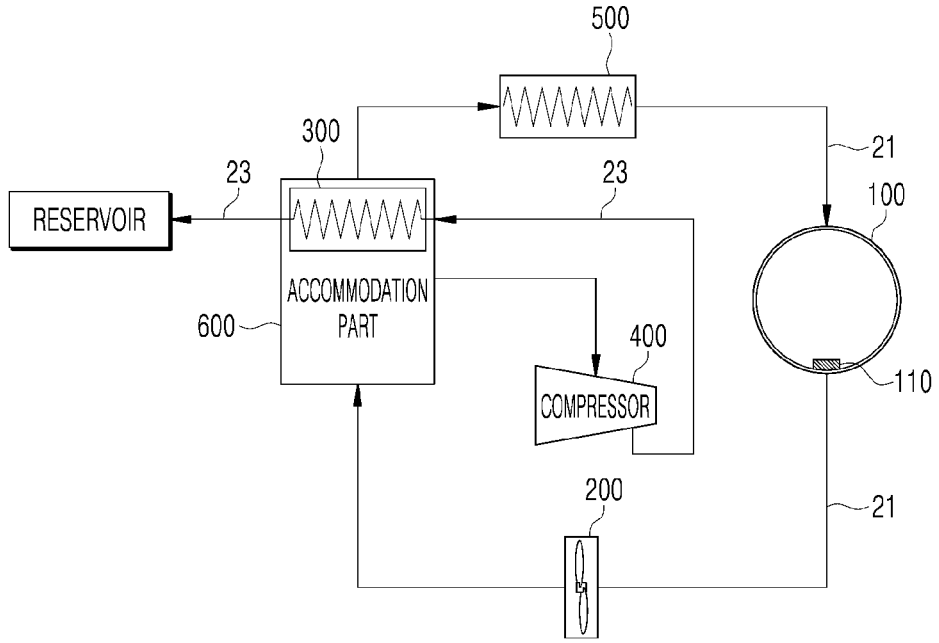
FIG. 2 is a diagram showing the structure of a dryer according to an embodiment of the present disclosure.

FIG. 2 is a diagram showing the structure of a dryer according to an embodiment.

The dryer may be provided with a flow line through which the working fluid flows. The flow line may interconnect respective components of the dryer, which will be described below. The flow line may be configured as, for example, a pipe, a hose, a duct, or a combination thereof.

The flow line of the working fluid in the dryer may include a circulation line 21 and a non-circulation line 23.

The circulation line 21 is a line interconnecting a heating device 500, a tumbler 100, a fan 200, and a heat exchanger 300, and the working fluid may circulate along the circulation line 21. The fan 200 may blow the working fluid so that the working fluid flows along the circulation line 21.

The non-circulation line 23 may branch from the circulation line 21 prior to the heat exchanger 300 so as to be connected to a compressor 400, and may interconnect the compressor 400, the heat exchanger 300, and a reservoir. The working fluid flowing through the non-circulation line 23 may be introduced into and compressed by the compressor 400, and may then pass through the heat exchanger 300.

A portion of the working fluid in the circulation line 21 may be introduced into the non-circulation line 23 that branches from the circulation line 21. The working fluid introduced into the non-circulation line 23 may be compressed by the compressor 400, and thus may be heated to a high temperature.

The heated working fluid discharged from the compressor 400 in the non-circulation line 23 may be introduced into the heat exchanger 300, may exchange heat with the working fluid in the circulation line 21, which has a relatively low temperature, and may be discharged from the heat exchanger 300.

Hereinafter, the structure of the dryer according to the embodiment will be described in detail with reference to FIG. 2 and the drawings below.

Referring to FIG. 2, the dryer according to the embodiment may include the heating device 500, the tumbler 100, the fan 200, the heat exchanger 300, and the compressor 400.

The tumbler 100 may be connected at the entrance thereof to the heating device 500. The structure and function of the tumbler 100 are as described above.

The heating device 500 may be disposed between the tumbler 100 and the heat exchanger 300 in the circulation line 21. The heating device 500 may be configured as, for example, an electric heater, but the disclosure is not limited thereto.

The heating device 500 may be used, for example, for initial heating of the working fluid flowing through the circulation line 21. Therefore, operation of the heating device 500 may be stopped when the initial heating is completed. In addition, even after the initial heating is completed, the heating device 500 may be operated again at any time in order to heat the working fluid in the circulation line 21.

In order to rapidly and efficiently perform a drying operation, it is necessary to quickly heat the object to be dried at the initial stage of the drying operation. When the compressor 400 operates, the working fluid in the non-circulation line 23 may be heated, and the working fluid in the circulation line 21 may be heated through heat exchange in the heat exchanger 300.

According to the embodiment, the working fluid in the circulation line 21 may be further heated using the heating device 500 in order to more rapidly heat the object to be dried to thus more quickly evaporate the water contained in the object to be dried.

The fan 200 may be disposed so as to be connected to the exit of the tumbler 100. The fan 200 and the tumbler 100 may be connected to each other via the circulation line 21 of the working fluid. The fan 200 may blow the working fluid introduced from the tumbler 100 so that the working fluid circulates through the circulation line 21.

The heat exchanger 300 may be disposed in the flow line of the working fluid that is connected to the exit of the fan 200. That is, the heat exchanger 300 may be disposed in the circulation line 21 of the working fluid that interconnects the fan 200 and the tumbler 100.

In addition, the heat exchanger 300 may be configured such that the non-circulation line 23 of the working fluid that is connected to the exit of the compressor 400 passes therethrough.

Due to this structure, the working fluid in the circulation line 21, which has a relatively low temperature, and the working fluid in the non-circulation line 23, which is compressed by the compressor 400 and thus has a relatively high temperature, may exchange heat therebetween in the heat exchanger 300.

Meanwhile, during initial heating of the working fluid, the working fluid in the non-circulation line 23 is further heated by the heating device 500, whereby heat exchange may occur more actively in the heat exchanger 300.

The working fluid in the circulation line 21, which is heated through the heat exchanger 300, may flow back into the tumbler 100, and may heat and dry the object to be dried in the tumbler 100.

The dryer according to the embodiment may further include an accommodation part 600, in which the heat exchanger 300 is accommodated and through which the working fluid flows. For example, the accommodation part 600 may be configured as a duct, and may constitute a part of the circulation line 21.

The accommodation part 600 may be designed to have a large cross-sectional area in order to increase the contact area between the working fluid in the circulation line 21 and the surface of the heat exchanger 300, thereby increasing the efficiency of heat exchange between the working fluid in the circulation line 21 and the working fluid in the non-circulation line 23.

However, it is appropriate to set the cross-sectional area of the accommodation part 600 in consideration of the overall size of the dryer, the size of the space occupied by the accommodation part 600, and the size of the heat exchanger 300.

As shown in FIG. 2, the accommodation part 600 may be connected to the flow line connected to the exit of the fan 200, to the flow line connected to the entrance of the heating device 500, and to the flow line connected to the entrance of the compressor 400.

That is, the accommodation part 600 may be connected both to the circulation line 21 and to the non-circulation line 23 of the working fluid. The heat exchanger 300 may be configured as, for example, an open type, in which the working fluid in the circulation line 21 and the working fluid in the non-circulation line 23 mix with each other, or a closed type, in which the two working fluids flow separately from each other. The heat exchanger 300 according to the embodiment may be configured as, for example, a closed type.

When the closed-type heat exchanger 300 is used, the non-circulation line 23 of the working fluid may be directly connected to the heat exchanger 300 disposed in the accommodation part 600, and the working fluid in the non-circulation line 23 may be separated from the working fluid in the circulation line 21 inside the accommodation part 600, rather than being mixed therewith.

The compressor 400 may be connected at the entrance thereof to the flow line connected to the exit of the fan 200, and may be connected at the exit thereof to the entrance of the heat exchanger 300.

The compressor 400 may be connected at the entrance thereof to the circulation line 21 of the working fluid that is connected to the exit of the fan 200, and may be connected at the exit thereof to the entrance of the heat exchanger 300.

The compressor 400 may be connected to the non-circulation line 23 of the working fluid, and a portion of the working fluid flowing through the circulation line 21 may be introduced into the compressor 400. The working fluid introduced into the non-circulation line 23 may be compressed by the compressor 400 to a high temperature, and may then be introduced into the heat exchanger 300.

The compressor 400 may be configured as any of various types, such as, for example, a reciprocating type, a rotary type, a screw type, a scroll type, a centrifugal type, and an axial type. It is appropriate to select the type of compressor 400 in consideration of the size and the specific characteristics thereof.

The dryer according to the embodiment may further include a reservoir and a controller.

The reservoir may be connected to the exit of the heat exchanger 300. While the working fluid discharged from the compressor 400 passes through the heat exchanger 300, at least a portion of the steam contained in the working fluid may be condensed, so liquid water, i.e. condensed water, may be generated. The reservoir may store the condensed water introduced from the heat exchanger 300.

Although not shown, the controller may be electrically connected to the heating device 500, the fan 200, and the compressor 400. In addition, the controller may be electrically connected to other components of the dryer that need to be electrically controlled.

The controller may control the respective components of the dryer, and thus may control the overall operation of the dryer according to the embodiment. For example, the controller may apply power to the heating device 500, may control the operation of the fan 200, may control the operation of the compressor 400, or may control opening and closing of a control valve.

As described above, the controller may be connected to the user interface 10 and the transceiver to receive a user's command, to transmit a necessary notification to the user, or to communicate with an external device such as a server.

The heat exchanger 300 according to the embodiment may be configured such that the working fluid having a relatively high temperature introduced from the compressor 400 passes through a narrow closed pipe and such that the working fluid having a relatively low temperature introduced from the fan 200 and passing through the accommodation part 600 comes into contact with the outer surface of the pipe.

Due to this structure, heat may be transferred from the working fluid having a relatively high temperature, which passes through the pipe, to the working fluid having a relatively low temperature, which contacts the outer surface of the pipe and passes through the accommodation part 600.

While the dryer is operating, foreign substances, such as lint, which are separated from the object to be dried in the tumbler 100, may be contained in the working fluid, and may move through the circulation line 21 and the non-circulation line.

These foreign substances may adversely affect the respective components of the dryer. In particular, the foreign substances may collect inside the compressor 400 or the heat exchanger 300, which has a narrow pipe for flow of the fluid and a complicated structure, leading to clogging of the pipe in the compressor 400 or the heat exchanger 300 or abnormal operation of the constituent parts thereof.

The foreign substances may impede the operation of the respective components of the dryer, such as the compressor 400 and the heat exchanger 300, thereby deteriorating the performance of the dryer and, in severe cases, causing malfunction of the dryer.

Therefore, the embodiment proposes a structure for preventing foreign substances separated from the object to be dried from moving through the circulation line 21 and the non-circulation line 23. This will be described later with reference to FIG. 2.

In addition, the embodiment proposes a structure for cleaning the inside of the heat exchanger 300 or the compressor 400, in which foreign substances easily collect, in order to remove the foreign substances therefrom. This will be described later with reference to FIGS. 3, 4, and 5.

Referring to FIG. 2, the tumbler 100 may be provided with a second filter 110. The second filter 110 may be mounted to the exit of the tumbler 100, which is connected to the fan 200. Thus, the working fluid in the tumbler 100 may be discharged therefrom via the second filter 110, and may flow to the fan 200.

Therefore, foreign substances, such as lint, may be removed from the working fluid by the second filter 110, and the working fluid containing very little or no foreign substances may be discharged from the tumbler 100, and may flow through the circulation line 21 and the non-circulation line 23.

According to the embodiment, foreign substances contained in the working fluid in the tumbler 100 may be filtered out by the second filter 110 when the working fluid is discharged from the tumbler 100. Accordingly, it is possible to effectively prevent foreign substances, such as lint, from moving through the circulation line 21 and the non-circulation line 23 and collecting in the respective components of the dryer.

Figure 3:
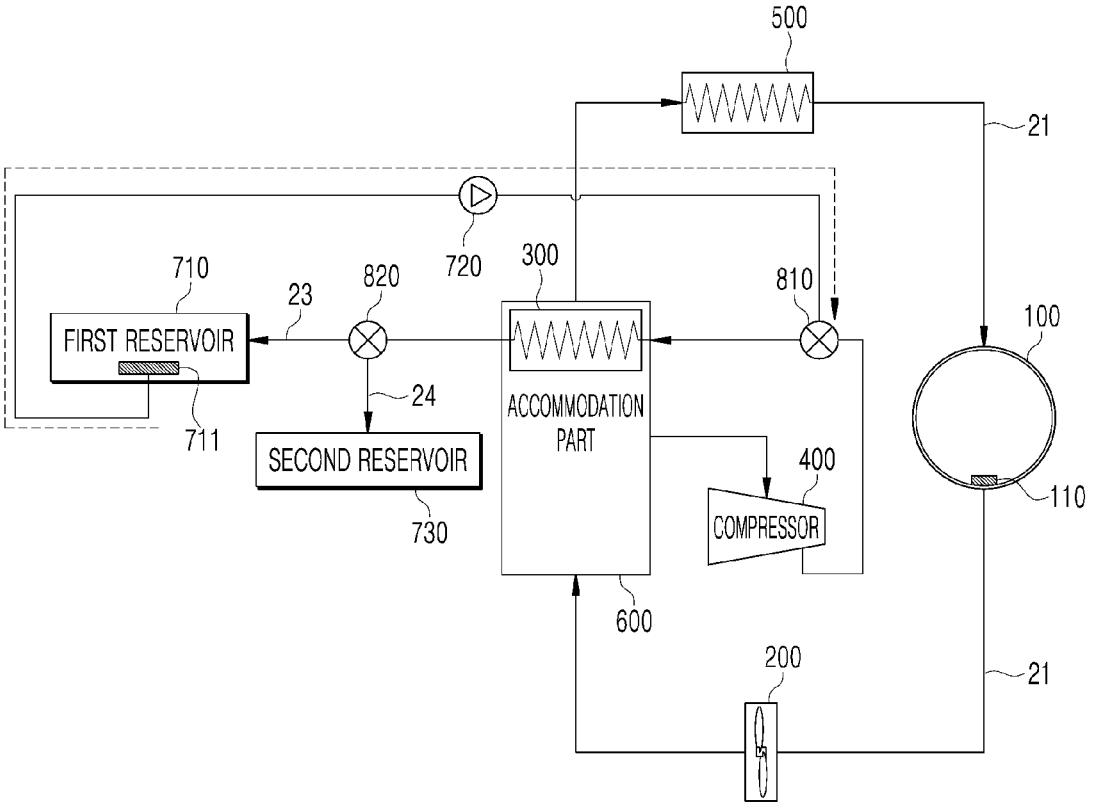
FIG. 3 is a diagram showing the structure of a dryer according to another embodiment of the present disclosure.

FIG. 3 is a diagram showing the structure of a dryer according to another embodiment. The dryer may include a first cleaning unit for cleaning the inside of the heat exchanger 300 in order to remove foreign substances, such as lint, collected in the heat exchanger 300.

The dryer may be driven in a drying mode for drying the object to be dried, a heat exchanger cleaning mode for cleaning the heat exchanger 300 using the first cleaning unit, and a compressor cleaning mode for cleaning the compressor 400 using a second cleaning unit.

However, as will be described below, in some embodiments, the dryer may have a structure in which only the drying mode and the heat exchanger cleaning mode are performed, or may have a structure in which all of the drying mode, the heat exchanger cleaning mode, and the compressor cleaning mode are performed.

The heat exchanger cleaning mode or the compressor cleaning mode may be performed after the drying mode is completed. In the case in which the drying mode is performed multiple times in the dryer, the heat exchanger cleaning mode or the compressor cleaning mode may be performed after the first drying mode is completed, and a subsequent drying mode may be performed after the heat exchanger cleaning mode or the compressor cleaning mode is completed.

Meanwhile, in the case of a dryer having a structure capable of performing both the heat exchanger cleaning mode and the compressor cleaning mode, the heat exchanger cleaning mode and the compressor cleaning mode may be sequentially performed. Any one of the heat exchanger cleaning mode and the compressor cleaning mode may be performed first, and then the remaining one thereof may be performed.

The first cleaning unit may be connected to the entrance and the exit of the heat exchanger 300, and may include a first reservoir 710, a first pump 720, and a first cleaning line 22. The first cleaning line 22 may be connected at one end thereof to the first reservoir 710, and may be connected at the other end thereof to the heat exchanger 300. A cleaning liquid may flow through the first cleaning line 22 to clean the inside of the heat exchanger 300. In this case, the condensed water stored in the first reservoir 710 may be used as the cleaning liquid.

The first reservoir 710 may be connected at the entrance thereof to the exit of the heat exchanger 300. The entrance of the first reservoir 710 may be connected to the heat exchanger 300. Accordingly, the working fluid introduced into the first reservoir 710 from the heat exchanger 300 may be stored in the first reservoir 710 as condensed water, and the condensed water stored in the first reservoir 710 may flow through the first cleaning line 22 to clean the heat exchanger 300.

The first pump 720 may be connected at the exit thereof to the entrance of the heat exchanger 300, and may be connected at the entrance thereof to the first reservoir 710. The first pump 720 may be disposed in the first cleaning line 22, and may be electrically connected to the controller so that operation thereof is controlled by the controller.

The first cleaning line 22 may interconnect the first reservoir 710 and the first pump 720. In addition, the first cleaning line 22 may be connected at one end thereof to the first reservoir 710, and may be connected at the other end thereof to the non-circulation line 23 interconnecting the compressor 400 and the heat exchanger 300.

That is, the first cleaning line 22 may be connected at one end thereof to the first reservoir 710, and may be connected at the other end thereof to the non-circulation line 23. The first pump 720 may be disposed in the first cleaning line 22.

A first valve 810, which is configured as a three-way valve, may be disposed at a portion at which the first cleaning line 22 and the non-circulation line 23 are connected to each other. The first valve 810 may be electrically connected to the controller so that operation thereof is controlled by the controller.

The first valve 810 may control the flow paths of the working fluid and the cleaning liquid such that the working fluid flows from the compressor 400 to the heat exchanger 300 in the drying mode and such that the cleaning liquid flows from the first reservoir 710 to the heat exchanger 300 via the first pump 720 in the heat exchanger cleaning mode.

The non-circulation line 23 may interconnect the heat exchanger 300 and the first reservoir 710.

In addition, the dryer may further include a discharge line 24 and a second reservoir 730. The discharge line 24 may branch from the non-circulation line 23 interconnecting the heat exchanger 300 and the first reservoir 710. The second reservoir 730 may be provided so as to be connected to the exit of the discharge line 24.

A second valve 820, which is configured as a three-way valve, may be disposed at a portion at which the non-circulation line 23 and the discharge line 24 are connected to each other. The second valve 820 may control the flow path of the working fluid discharged from the heat exchanger 300 such that the working fluid flows to the first reservoir 710 or to the second reservoir 730 as needed.

For example, when it is necessary to supply the cleaning liquid to the first reservoir 710, the second valve 820 may close the exit thereof that is connected to the second reservoir 730 so that the working fluid discharged from the heat exchanger 300 flows to the first reservoir 710.

Meanwhile, when sufficient cleaning liquid is stored in the first reservoir 710 and thus it is not necessary to supply the cleaning liquid to the first reservoir 710, the second valve 820 may close the exit thereof that is connected to the first reservoir 710 so that the working fluid discharged from the heat exchanger 300 flows to the second reservoir 730.

According to the embodiment, the dryer may clean the heat exchanger 300 using the first cleaning unit, thereby effectively preventing foreign substances, such as lint, from collecting in the heat exchanger 300, and consequently effectively preventing performance deterioration, malfunction, and lifespan reduction of the heat exchanger 300 due to the foreign substances.

The first reservoir 710 may be provided with a first filter 711. The first filter 711 may be mounted to the exit of the first reservoir 710, which is connected to the first cleaning line 22. Condensed water discharged from the heat exchanger 300 and accommodated in the first reservoir 710 may be used as the cleaning liquid. Foreign substances, such as lint, may be contained in the condensed water in the first reservoir 710, and the first filter 711 may prevent the foreign substances, such as lint, from being introduced into the first cleaning line 22.

The first filter 711 may have any of various structures, so long as the same allows condensed water to pass therethrough and blocks foreign substances, such as lint.

As indicated by the dotted-line arrow in FIG. 3, in the heat exchanger cleaning mode, the working fluid stored in a liquid state in the first reservoir 710, i.e. the cleaning liquid, may sequentially flow through the first filter 711, the first pump 720, the first valve 810, the heat exchanger 300, and the second valve 820 to clean the heat exchanger 300.

In this case, the cleaning liquid introduced into the second valve 820 may be selectively discharged to the first reservoir 710 or to the second reservoir 730 according to the operation of the second valve 820.

When the heat exchanger 300 is completely cleaned, the operation of the first pump 720 may be stopped, and the first valve 810 may close the entrance thereof that is connected to the first cleaning line 22, and may open the entrance thereof that is connected to the non-circulation line 23, whereby the dryer may again perform the drying mode.

Figure 4:
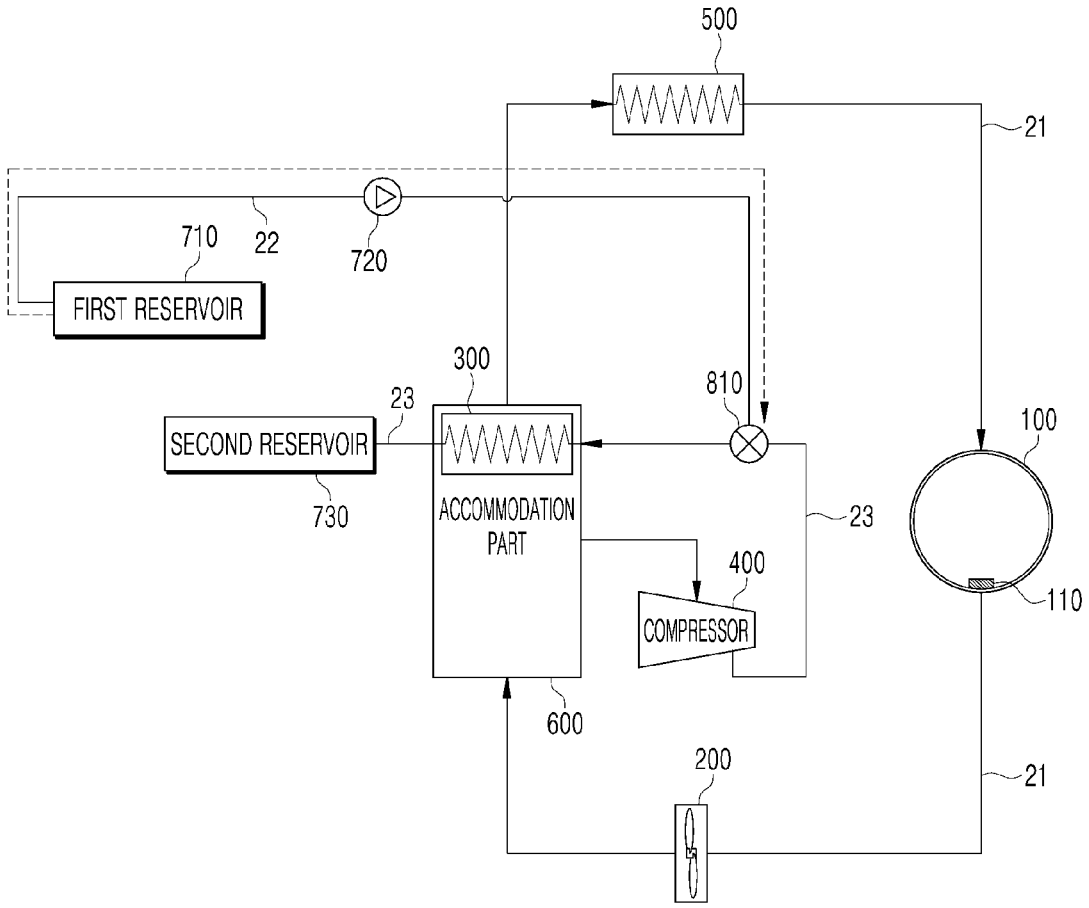
FIG. 4 is a diagram showing the structure of a dryer according to still another embodiment of the present disclosure.

FIG. 4 is a diagram showing the structure of a dryer according to still another embodiment. Referring to FIG. 4, the dryer may further include a second reservoir 730, which is disposed at the end of the non-circulation line 23 and is connected to the heat exchanger 300.

A first cleaning unit of the dryer shown in FIG. 4 is similar to the first cleaning unit shown in FIG. 3, but has the following differences therefrom.

Compared to the dryer shown in FIG. 3, the dryer shown in FIG. 4 is structured such that the second valve 820 is omitted, the first reservoir 710 and the second reservoir 730 are not connected to each other, and the first reservoir 710 is not provided with a filter.

A cleaning liquid is introduced into the first reservoir 710 from an external supply source. The cleaning liquid discharged from the first reservoir 710 flows to the second reservoir 730 through the first cleaning line 22, and does not circulate through the first cleaning line 22 again.

The first cleaning unit shown in FIG. 4 may receive separate clean cleaning liquid from an external supply source.

As indicated by the dotted-line arrow in FIG. 4, in the heat exchanger cleaning mode, the cleaning liquid stored in a liquid state in the first reservoir 710 may be discharged from the first reservoir 710, and may sequentially flow through the first pump 720, the first valve 810, the heat exchanger 300, and the second reservoir 730 to clean the heat exchanger 300.

In the first cleaning unit shown in FIG. 3, because the condensed water introduced into the first reservoir 710 from the heat exchanger 300 is used as the cleaning liquid, although the first filter 711 is provided in the first reservoir 710, foreign substances, such as lint, are likely to be contained in the cleaning liquid.

However, in the first cleaning unit shown in FIG. 4, separate clean cleaning liquid containing no foreign substances is used to clean the heat exchanger 300. Accordingly, the first cleaning unit shown in FIG. 4 may exhibit improved efficiency of cleaning of the inside of the heat exchanger 300 compared to the first cleaning unit shown in FIG. 3.

However, in the first cleaning unit shown in FIG. 4, the working fluid flowing through the non-circulation line 23 is not used as a cleaning liquid, and the cleaning liquid that has passed once through the heat exchanger 300 does not circulate through the first cleaning line 22 again. Therefore, the first cleaning unit shown in FIG. 4 may be slightly disadvantageous from the aspect of costs compared to the first cleaning unit shown in FIG. 3.

Figure 5:
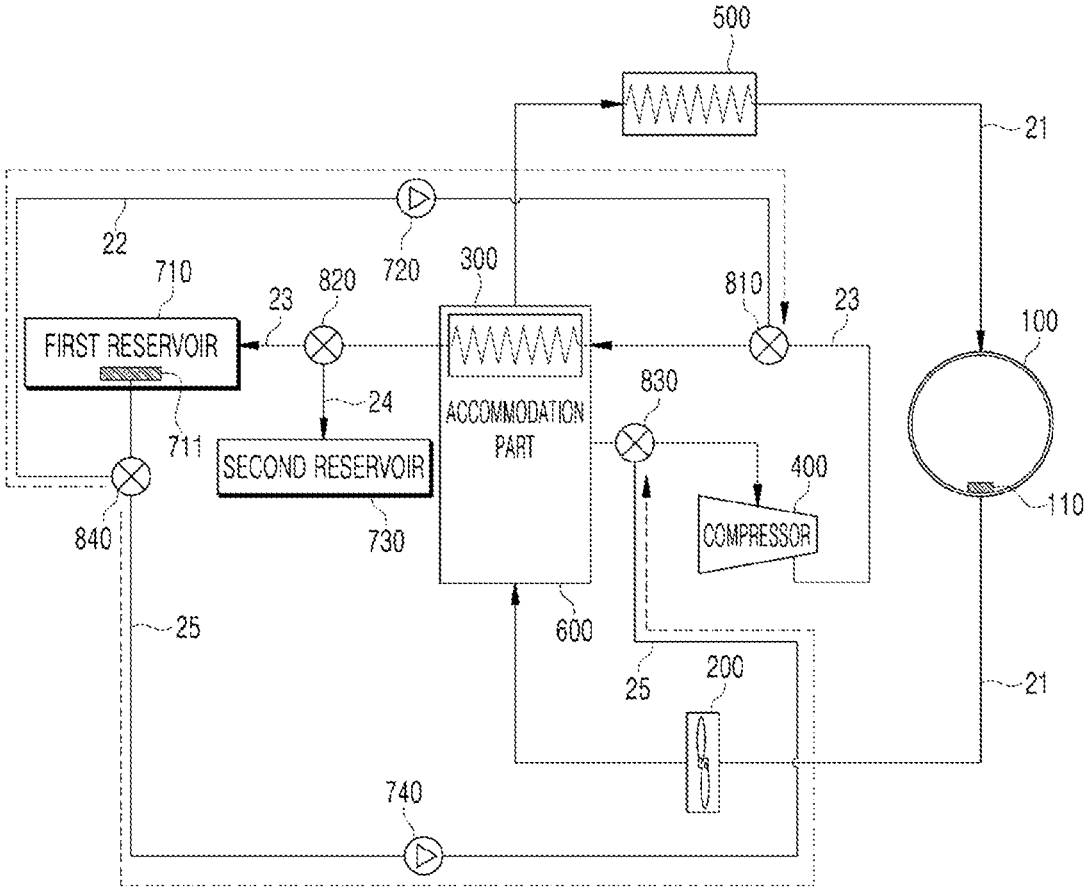
FIG. 5 is a diagram showing the structure of a dryer according to still another embodiment of the present disclosure.

FIG. 5 is a diagram showing the structure of a dryer according to still another embodiment. The dryer shown in FIG. 5 may include both a first cleaning unit for cleaning the heat exchanger 300 and a second cleaning unit for cleaning the compressor 400.

In the compressor cleaning mode, condensed water accommodated in the first reservoir 710 may be introduced into the compressor 400 to remove foreign substances, such as lint, present in the compressor 400.

The dryer shown in FIG. 5 may further include other components in addition to the components of the dryer shown in FIG. 3. Hereinafter, duplicate descriptions of the same components as those described above with reference to FIG. 3 will be omitted, and the additional components will be mainly described.

The first reservoir 710 may be provided at the exit thereof with a first filter 711. The structure and the function of the first filter 711 are the same as described above.

The dryer may further include a second cleaning unit, which is connected to the entrance and the exit of the compressor 400. The second cleaning unit may include a second cleaning line 25, which is connected at the entrance thereof to the first reservoir 710 and is connected at the exit thereof to the compressor 400.

The second cleaning line 25 may be connected to the first cleaning line 22 at a point downstream of the exit of the first reservoir 710.

As shown in FIG. 5, the non-circulation line 23 may interconnect the circulation line 21 and the compressor 400, and the second cleaning line 25 may be connected to the non-circulation line 23 at a point between the circulation line 21 and the compressor 400.

A third valve 830 may be disposed at a portion at which the non-circulation line 23 and the second cleaning line 25 are connected to each other. In addition, a fourth valve 840 may be disposed at a portion at which the first cleaning line 22 and the second cleaning line 25 are connected to each other.

Each of the third valve 830 and the fourth valve 840 may be configured as a three-way valve. The third valve 830 and the fourth valve 840 may be electrically connected to the controller so that operation thereof is controlled by the controller.

In the drying mode, the third valve 830 may close the entrance thereof that is connected to the second cleaning line 25, and the first valve 810 may close the entrance thereof that is connected to the first cleaning line 22, whereby the working fluid introduced into the compressor 400 may pass through the non-circulation line 23.

In the heat exchanger cleaning mode, the fourth valve 840 may close the exit thereof that is connected to the second cleaning line 25, and the first valve 810 may close the entrance thereof that is connected to the compressor 400, whereby the cleaning liquid discharged from the first reservoir 710 may pass through the heat exchanger 300 via the first cleaning line 22.

In the compressor cleaning mode, the fourth valve 840 may close the exit thereof that is connected to the first cleaning line 22, the third valve 830 may close the entrance thereof that is connected to the accommodation part 600, and the first valve 810 may close the entrance thereof that is connected to the first cleaning line 22. Accordingly, the cleaning liquid discharged from the first reservoir 710 may flow through the second cleaning line 25 and the non-circulation line 23 to clean the inside of the compressor 400.

The dryer may further include a second pump 740, which is disposed in the second cleaning line 25. The second pump 740 may be electrically connected to the controller so that operation thereof is controlled by the controller.

The second pump 740 may be driven in the compressor cleaning mode in order to make the cleaning liquid accommodated in the first reservoir 710 flow through the second cleaning line 25 and the non-circulation line 23.

However, in the case in which the compressor 400 is capable of operating in the compressor cleaning mode and thus the cleaning liquid is capable of being moved by the operation of the compressor 400, the second pump 740 may be omitted.

In the compressor cleaning mode, the working fluid stored in a liquid state in the first reservoir 710, i.e. the cleaning liquid, may be discharged from the first reservoir 710, and may be introduced into the compressor 400 after sequentially passing through the fourth valve 840, the second pump 740, and the third valve 830. That is, in the compressor cleaning mode, the cleaning liquid may flow through the second cleaning line 25, as indicated by the dotted-line arrow in FIG. 5.

The cleaning liquid that has passed through the compressor 400 may flow through the non-circulation line 23, may pass through the heat exchanger 300, and may be introduced into the first reservoir 710 or the second reservoir 730. In this case, the second valve 820 may control the flow path of the cleaning liquid discharged from the heat exchanger 300 such that the cleaning liquid flows to the first reservoir 710 or to the second reservoir 730 as needed.

As described above, cleaning of the heat exchanger 300 and cleaning of the compressor 400 may be performed in any order. That is, the heat exchanger 300 may be cleaned and the compressor 400 may then be cleaned, either in that order or in the reverse order.

However, because foreign substances, such as lint, removed from the compressor 400 are likely to collect in the heat exchanger 300, it may be preferable to first clean the compressor 400 and then clean the heat exchanger 300.

According to the embodiment, the dryer may clean the compressor 400 using the second cleaning unit, thereby effectively preventing foreign substances, such as lint, from collecting in the compressor 400, and consequently effectively preventing performance deterioration, malfunction, and lifespan reduction of the compressor 400 due to the foreign substances.

The present disclosure described as above is not limited by the aspects described herein and accompanying drawings. It should be apparent to those skilled in the art that various substitutions, changes, and modifications that are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

MODE(S) FOR CARRYING OUT THE INVENTION

Many modifications to the above embodiments may be made without altering the nature of the invention. The dimensions and shapes of the components and the construction materials may be modified for particular circumstances. While various embodiments have been described above, it should be understood that they have been presented by way of example only, and not as limitations.

INDUSTRIAL APPLICABILITY

According to the dryer of the present disclosure, foreign substances contained in the working fluid discharged from the tumbler may be filtered out by the second filter, and accordingly, it is possible to effectively prevent foreign substances, such as lint, from moving through the circulation line and the non-circulation line and collecting in the respective components of the dryer. As such, since the present disclosure overcomes the limits of existing technology, the present disclosure is not only useful in the field discussed herein, but also increases the marketability and business possibility of apparatuses to which the present disclosure is applicable, and can be practically and explicitly implemented. Accordingly, the present disclosure has industrial applicability.

The invention claimed is:

1. A dryer comprising:

a heating device;

a tumbler having an entrance connected to the heating device, the tumbler being configured to receive one or more objects to be dried;

a fan connected to an exit of the tumbler;

a heat exchanger connected to an exit of the fan through a flow line, the flow line being configured to carry a working fluid;

a circulation line connected to the exit of the fan and configured to carry the working fluid;

a compressor having (i) an entrance connected to the circulation line and (ii) an exit connected to an entrance of the heat exchanger;

a first reservoir having an entrance connected to an exit of the heat exchanger;

a first pump having an exit connected to the entrance of the heat exchanger;

a non-circulation line that connects the compressor to the heat exchanger and is configured to provide the working fluid discharged from the compressor to the heat exchanger; and a first cleaning line that connects the first reservoir to the first pump, the first cleaning line having (i) a first end connected to the first reservoir and (ii) a second end connected to the non-circulation line, wherein the heat exchanger is configured to discharge the working fluid toward the first reservoir after exchanging heat between (i) the working fluid that is provided from the compressor to the heat exchanger through the non-circulation line and has a first temperature and (ii) the working fluid that is in the circulation line and has a second temperature less than the first temperature.

2. The dryer according to claim 1, further comprising:

a first valve disposed at the second end of the first cleaning line, the first valve comprising a three-way valve that includes two inlets and one outlet or one inlet and two outlets.

3. The dryer according to claim 2, wherein the first reservoir has an exit connected to the first cleaning line, the first reservoir comprising a first filter that is disposed at the exit of the first reservoir.

4. The dryer according to claim 3, wherein the non-circulation line further connects between the heat exchanger and the first reservoir, and wherein the dryer further comprises:

a discharge line that is branched from a point of the non-circulation line between the heat exchanger and the first reservoir; and a second reservoir connected to an exit of the discharge line.

5. The dryer according to claim 4, further comprising:

a second valve disposed at a connecting point between the non-circulation line and the discharge line, the second valve comprising a three-way valve that includes one inlet and two outlets or two inlets and one outlet.

6. The dryer according to claim 5, wherein the first reservoir is configured to store the working fluid in a liquid state, and wherein the non-circulating line and the first cleaning line are configured to, in a heat exchanger cleaning mode for cleaning the heat exchanger, guide the working fluid in the first reservoir to the second valve sequentially through the first filter, the first pump, the first valve, and the heat exchanger.

7. The dryer according to claim 2, further comprising:

a second reservoir disposed at an end of the non-circulation line and connected to the heat exchanger.

8. The dryer according to claim 7, wherein the first reservoir is configured to store the working fluid in a liquid state, and wherein the non-circulating line and the first cleaning line are configured to, in a heat exchanger cleaning mode for cleaning the heat exchanger, guide the working fluid from the first reservoir to the second reservoir sequentially through the first pump, the first valve, and the heat exchanger.

9. The dryer according to claim 2, wherein the first reservoir comprises a first filter that is disposed an exit of the first reservoir, the exit of the first reservoir being connected to the entrance of the compressor.

10. The dryer according to claim 9, further comprising a second cleaning line that connects the exit of the first reservoir to the entrance of the compressor.

11. The dryer according to claim 10, wherein the second cleaning line connects between (i) a first connecting point that is disposed at the first end of the first cleaning line downstream relative to the exit of the first reservoir and (ii) a second connecting point that is disposed at a position of the non-circulation line between the circulation line and the compressor.

12. The dryer according to claim 11, further comprising:

a third valve that is disposed at the second connecting point and connects the second cleaning line to the non-circulation line; and a fourth valve that is disposed at the first connecting point and connects the first cleaning line to the second cleaning line.

13. The dryer according to claim 12, wherein each of the third valve and the fourth valve comprises a three-way valve that includes two inlets and one outlet or one inlet and two outlets.

14. The dryer according to claim 12, further comprising a second pump disposed at the second cleaning line.

15. The dryer according to claim 14, wherein the first reservoir is configured to store the working fluid in a liquid state, and wherein the second cleaning line is configured to, in a compressor cleaning mode for cleaning the compressor, guide the working fluid from the first reservoir to the compressor sequentially through the fourth valve, the second pump, and the third valve.

16. The dryer according to claim 1, wherein the tumbler comprises a filter disposed at the exit of the tumbler that is connected to the fan.

17. The dryer according to claim 5, further comprising a second cleaning line that connects an exit of the first reservoir to the compressor.

18. The dryer according to claim 17, further comprising:

a third valve disposed at a first end of the second cleaning line connected to the non-circulation line; and a fourth valve disposed at a second end of the second cleaning line connected to the exit of the first reservoir.

19. The dryer according to claim 1, wherein the working fluid comprises steam.

20. The dryer according to claim 1, further comprising:

a first valve disposed at the second end of the first cleaning line;

a second valve between the heat exchanger and the first reservoir;

a second cleaning line having (i) a first end connected to a point between the heat exchanger and the compressor and (ii) a second end connected to an exit of the first reservoir, the exit of the first reservoir being connected to the first cleaning line;

a third valve disposed at the first end of the second cleaning line; and a fourth valve disposed at the second end of the second cleaning line.

* * * * *